US008172128B2

(12) United States Patent
Maura Eady

(10) Patent No.: US 8,172,128 B2
(45) Date of Patent: May 8, 2012

(54) COUNTER DEVICE

(76) Inventor: Jose Manuel Maura Eady, Madrid (ES)

( * ) Notice: Subject to any disclaimer, the term of this patent is extended or adjusted under 35 U.S.C. 154(b) by 448 days.

(21) Appl. No.: 12/307,217

(22) PCT Filed: Jun. 8, 2007

(86) PCT No.: PCT/EP2007/005103

§ 371 (c)(1),
(2), (4) Date: Sep. 1, 2009

(87) PCT Pub. No.: WO2008/003382

PCT Pub. Date: Jan. 10, 2008

(65) Prior Publication Data

US 2011/0220709 A1 Sep. 15, 2011

(30) Foreign Application Priority Data

Jul. 4, 2006 (ES) ..... 200601581 U

(51) Int. Cl.
*G06C 1/00* (2006.01)

(52) U.S. Cl. ..... 235/123; 235/103; 235/115; 235/91 R; 235/131 R; 160/127; 128/200.23

(58) Field of Classification Search ..... 235/123, 235/103, 115, 91 R, 131 R; 160/127; 128/200.23
See application file for complete search history.

(56) References Cited

U.S. PATENT DOCUMENTS

| | | | | |
|---|---|---|---|---|
| 1,539,048 | A | 5/1925 | Kuziel | |
| 2,875,950 | A | 3/1959 | Mast | |
| 3,811,032 | A * | 5/1974 | Neher | 235/1 C |
| 3,949,204 | A * | 4/1976 | Yang | 235/103 |
| 4,262,898 | A | 4/1981 | Lee | |
| 4,506,373 | A * | 3/1985 | Kratt | 377/88 |
| 5,517,008 | A * | 5/1996 | Francart, Jr. | 235/91 F |
| 5,565,861 | A * | 10/1996 | Mettler et al. | 340/870.02 |
| 5,969,315 | A * | 10/1999 | Schulze | 235/91 R |
| 6,056,118 | A * | 5/2000 | Hargus et al. | 206/438 |
| 6,446,627 | B1 * | 9/2002 | Bowman et al. | 128/200.23 |
| 2009/0014131 | A1 * | 1/2009 | Mullet et al. | 160/127 |

* cited by examiner

*Primary Examiner* — Allyson Trail
(74) *Attorney, Agent, or Firm* — Sturm & Fix LLP

(57) ABSTRACT

Improved counter device (1) having a hollow casing (2) on the inside of which a mechanical type of numerator assembly (3) is housed with an activation device for the numerator assembly (3), and wherein said activation device has a rod (4) that is axially moveable in a straight line having a protrusion that is perpendicular to the rod (4) coupled in a elongated hole (7) located in a moving element (6) jointed in a fixed point that can move at an angle; said moveable element (6) being coupled at one end to a toothed wheel (8) connected to the hub of the numerator assembly (3) itself, in a such way that when the rod (4) moves, when receives a impulsion, to record a numeric count brought about by the slide of the protrusion along the mentioned elongated hole (7) in turn bringing about the angular sliding of the moveable element (6) that activates the toothed wheel of the assembly (3).

3 Claims, 2 Drawing Sheets

COUNTER DEVICE

OBJECT OF THE INVENTION

The object of this invention is an improved counter device that incorporates appreciable innovations and advantages compared to other devices with the same purpose.

More specifically it makes reference to an improved mechanical type of counter device, counter of cycles, that has a hollow casing on the inside of which a mechanical type of numerator assembly is housed with an activation device for the numerator assembly, applicable for example to cyclical working mechanisms such as in injection moulding, this being easily carried out and assembled.

BACKGROUND TO THE INVENTION

For some years the use of electrical, mechanical or magnetic counter devices has been well known which allow a simple control of the working cycles to be maintained in a simple and quick way for the different manufacturing processes, in such a way it allows a specific volume of production to be known at all times and likewise to maintain a control on when to carry out maintenance checks of the machinery being used.

DESCRIPTION OF THE INVENTION

This present invention has been developed for the purpose of providing an improved counter device that provides a control of the processes, in addition contributing other additional advantages that will become clear from the description that is included below.

The improved counter device object of this invention belongs to the type that has a hollow casing on the inside of which a mechanical type numerator assembly is housed with an activation device for the numerator assembly, and is characterised because said activation device has a rod that is axially moveable in a straight line that has a protrusion that is perpendicular to the rod that is coupled in a elongated hole located in a moving element jointed in a fixed point that can move at an angle; said moveable element being coupled at one end to a toothed wheel connected to the hub of the numerator assembly itself, in such a way that when the rod moves to record a numeric count brought about by the slide of the protrusion along the mentioned elongated hole in turn bringing about the angular sliding of the moveable element that activates the toothed wheel of the numerator assembly, and on which the longitudinal axis of the numerator assembly compared to the longitudinal axis of the rod are adjacent and parallel to each other.

In a more specific manner, an elastic return spring is fitted to the end of the rod to ensure the return of the rod to its starting point after each recording or impulse.

Conveniently, the casing of the counter device has a cover from which a tab protrudes towards the inside of the casing for the end of the elastic spring to rest on.

In accordance with another aspect of the counter device of the invention, the cover has a plurality of tabs with its end having a barb shape so as to fit into a plurality of corresponding grooves arranged on the inner side faces of the casing, said devices acting as fixing points as a guarantee of inviolability or undue manipulation of the mechanical numerator assembly fitted inside the casing, as in the event of separating the cover from the casing, at least one of the tabs would break. Therefore, any breach of cover can not be made without there being visible evidence of same having been forced.

Other characteristics and advantages of the improved counter device object of this present invention will become clear from a description of a preferred but not exclusive embodiment, which is shown in the attached drawings which are of illustrative but not in any way limitating.

A BRIEF DESCRIPTION OF THE DRAWINGS

DESCRIPTION OF A PREFERRED EMBODIMENT

Figure 3:
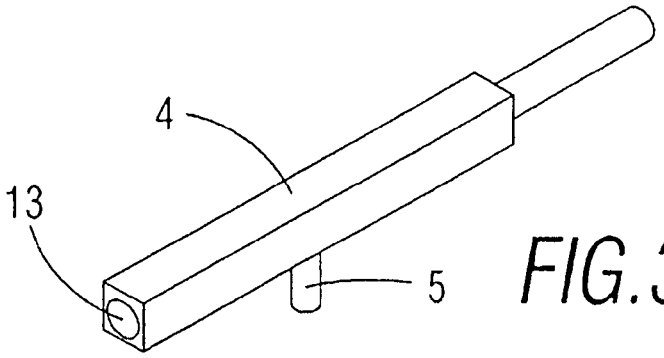
FIG. 3 shows an expanded perspective view of the rod providing the means of activation.

From the attached figures, it can be seen that the improved counter device of the mechanical type with the general reference (1) comprises of a reduced sized hollow casing (2) made from a mouldable plastic material on the inside of which a conventional mechanical type numerator assembly (3) is housed, assembled in a fixed manner, and with a means of activation for the numerator assembly (3). Said means of activation comprise of a rod (4) that can be axially moved in a straight line, represented by the arrow F in FIG. 1, that has a protrusion (5) (see FIG. 3) perpendicular to the rod (4) that is set in a elongated hole (7) located in a moveable element (6) jointed at a fixed point (P) that is moveable at an angle. The elongated hole (7) is fitted in an angular manner compared to the longitudinal axis of the rod (4).

Numerator assembly shall be understood as the mechanism that is formed by a plurality of wheels numbered from 0 to 9.

As can be seen, the moveable element (6) is made from a body that is basically flat and with an arched shape which is fitted at the non-jointed end to a toothed wheel (8), more specifically a ratchet, that is joined to the axle of the numerator assembly (3), the section of the element (6) that is in contact with said wheel (8) having a termination in the shape of a tab that is raised in respect of the rest of the piece (6) and which is in contact with the toothed surface of the ratchet. In this way, when the rod (4) moves to record a count brought about by the slide corresponding to the protrusion along the elongated hole (7) bringing about the angular movement of the mobile element (6) that activates the toothed wheel (8) of the numerator assembly (3) when the rod (4) receives an impulse.

It must also be highlighted that the imaginary longitudinal axis of the numerator assembly (3) compared to the longitudinal axis of the rod (4) are adjacent and parallel to each other and in which the inner axle fitted inside the numerator device (3) is fixed and static and under no circumstances works during the counting operation.

At the end of the rod (4) there is an elastic spring (9) fitted to ensure the return of the rod (4) to its starting point after each recording, one end of said spring (9) being housed in an inner cavity (13) fitted to the rod (4).

Figure 4:
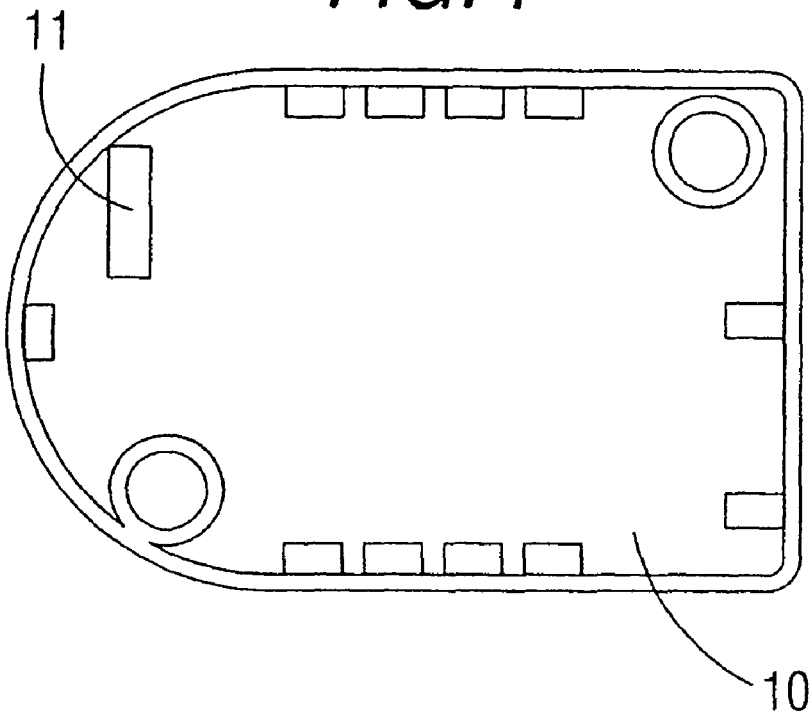
FIG. 4 shows a plan view from below corresponding to the cover of the counter device.
Figure 5:
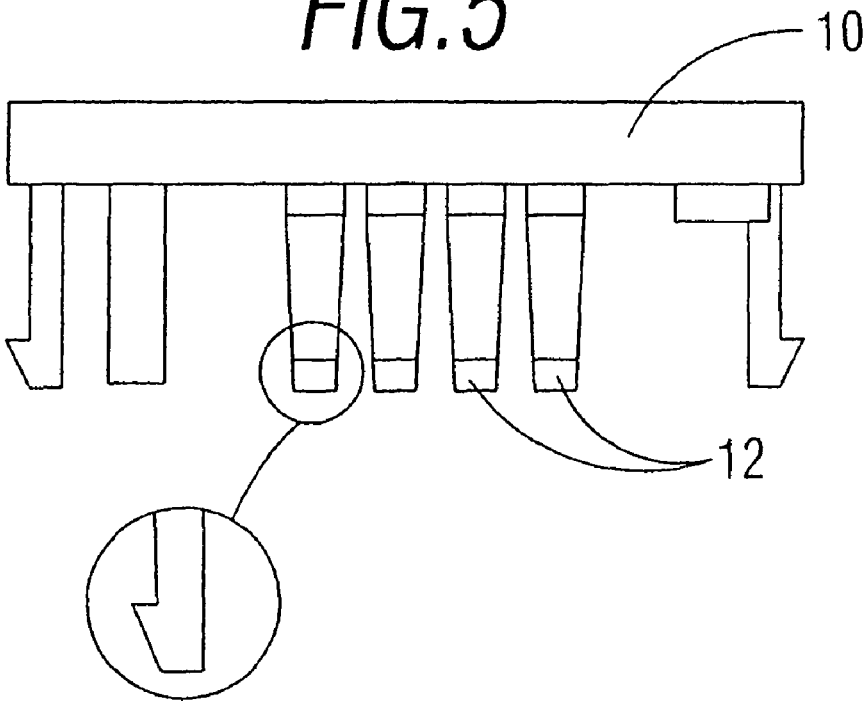
FIG. 5 shows an elevation view of the front cover including an expanded detailed view of the front section.

As and how shown in FIGS. 4 and 5, the casing (2) has a transparent cover (10) and made from a rigid material that has a shape that is the same as the casing body (2). A tab (11) with a flat geometry protrudes vertically and towards the inside of the casing (2) from the cover (10) and one end of the elastic spring (9) rests on it, this means that it acts as a type of stop.

In a more specific manner, the cover (10) has a plurality of tabs (12) with their ends in the shape of a barb designed to fit into a plurality of corresponding grooves arranged on the inner side walls of the casing (2), said fixing being designed to prevent fraud in the manufacture of unauthorised pieces by the owner, for example, the fitting of the here described counter to a mould.

Figure 1:
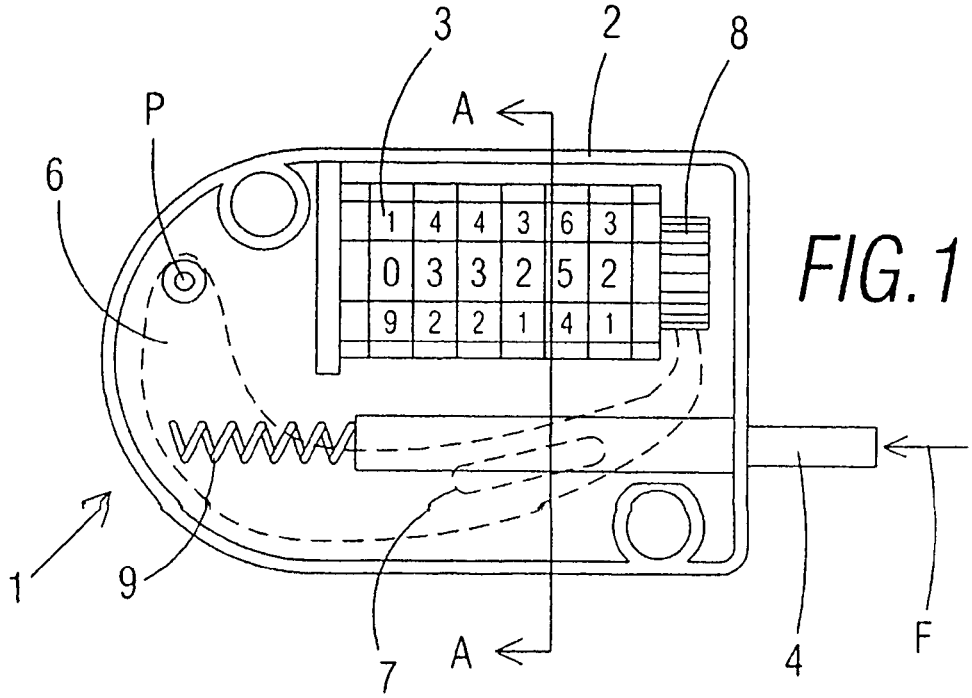
FIG. 1 shows a plan view from above of the improved counter device in accordance with the present invention without the cover represented and in a position at rest.
Figure 2:
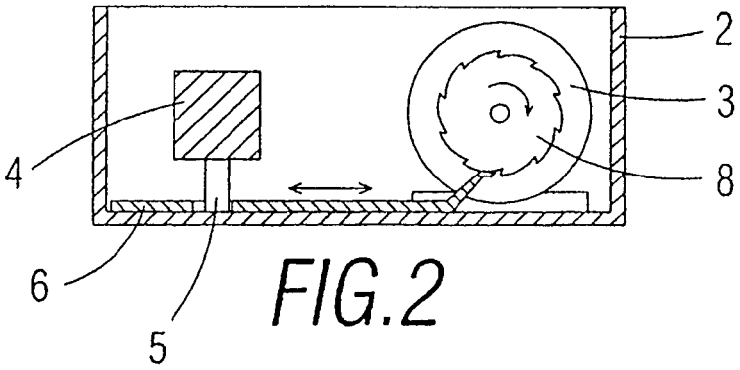
FIG. 2 shows an elevation section of the device represented in the previous figure along A-A.

In an additional manner, the joint between the casing (2) and the cover (10) also include screw elements (not shown) inserted by means of opening shown in FIGS. 1 and 2.

The details, shapes, sizes and other accessorial elements, likewise the materials used in the manufacture of the improved counter device of the invention can be appropriately substituted by others that are technically equivalent and do not stray away from the essentiality of the invention or the scope defined by the claims that are included below.

The invention claimed is:

1. Improved counter device comprising a hollow casing on the inside of which a mechanical type of numerator assembly is housed with an activation device for the numerator assembly, wherein said activation device has a rod that is axially moveable in a straight line that has a protrusion that is perpendicular to the rod that is coupled in an elongated hole located in a moving element jointed in a fixed point that can move at an angle wherein the casing of the counter device has a cover from which a tab protrudes towards the inside of the casing for the end of the elastic spring to rest on, and wherein the cover has a plurality of tabs with their ends in the shape of a barb designed to fit into a plurality of corresponding grooves arranged on the inner side walls of the casing;

said moveable element being coupled at one end to a toothed wheel connected to the hub of the numerator assembly itself, in such a way that when the rod moves, when receives a impulsion, to record a numeric count brought about by the slide of the protrusion along the mentioned elongated hole in turn bringing about the angular sliding of the moveable element that activates the toothed wheel of the numerator assembly;

and on which the longitudinal axis of the counter device compared to the longitudinal axis of the rod are adjacent and parallel to each other.

2. A counter device according to claim 1, wherein at the end of the rod there is an elastic spring to ensure the return of the rod to its starting point after each recording.

3. A counter device according to claim 1, wherein the toothed wheel comprises of a ratchet.

* * * * *